US007560010B2

(12) United States Patent
Meneghini

(10) Patent No.: US 7,560,010 B2
(45) **Date of Patent: *Jul. 14, 2009**

(54) DIAPHRAGM ELECTROLYTIC CELL

(75) Inventor: Giovanni Meneghini, Milan (IT)

(73) Assignee: De Nora Elettrodi S.p.A., Milan (IT)

( * ) Notice: Subject to any disclaimer, the term of this patent is extended or adjusted under 35 U.S.C. 154(b) by 528 days.

This patent is subject to a terminal disclaimer.

(21) Appl. No.: 10/503,278

(22) PCT Filed: Feb. 26, 2003

(86) PCT No.: PCT/EP03/01977

§ 371 (c)(1),
(2), (4) Date: Jul. 29, 2004

(87) PCT Pub. No.: WO03/074765

PCT Pub. Date: Sep. 12, 2003

(65) Prior Publication Data

US 2005/0145485 A1 Jul. 7, 2005

(30) Foreign Application Priority Data

Mar. 1, 2002 (IT) ..... MI2004A0416

(51) Int. Cl.
*C25C 1/00* (2006.01)
*C25B 9/00* (2006.01)

(52) U.S. Cl. ..... 204/252; 204/253; 204/194; 204/242; 204/259

(58) Field of Classification Search ..... 204/194, 204/242, 252, 259, 253
See application file for complete search history.

(56) References Cited

U.S. PATENT DOCUMENTS

| | | | | |
|---|---|---|---|---|
| 3,832,300 | A | 8/1974 | Messner et al. | |
| 3,976,556 | A * | 8/1976 | De Nora | 204/262 |
| 4,059,495 | A * | 11/1977 | de Nora et al. | 205/511 |
| 4,283,265 | A * | 8/1981 | Byrd | 204/252 |
| 4,377,462 | A | 3/1983 | Baker et al. | |
| 4,391,693 | A * | 7/1983 | Pimlott | 204/237 |
| 4,622,113 | A | 11/1986 | Satoh et al. | |
| 4,973,380 | A * | 11/1990 | Pryor et al. | 216/93 |
| 5,993,620 | A | 11/1999 | Meneghini et al. | |
| 7,354,506 | B2 * | 4/2008 | Meneghini et al. | 204/253 |
| 2004/0238351 | A1 * | 12/2004 | Meneghini et al. | 204/252 |

FOREIGN PATENT DOCUMENTS

WO WO 03/029522 A2 4/2003

* cited by examiner

*Primary Examiner*—Harry Wilkins
*Assistant Examiner*—Zulmariam Mendez
(74) *Attorney, Agent, or Firm*—Charles A. Muserlian

(57) ABSTRACT

A diaphragm electrolytic cell is composed of two or more overlaid modules; at least the upper modules having U-shaped anodes with diaphragm-coated cathodes housed within, allowing for a reduced electrode pitch.

23 Claims, 4 Drawing Sheets

DIAPHRAGM ELECTROLYTIC CELL

This application is a 371 of PCT/EP03/01977 filed Feb. 26, 2003.

BACKGROUND OF THE INVENTION

The world-wide production of chlorine, about 45 million tons per year, is carried out in electrolytic cells of different types; among these, the diaphragm electrolytic cell, by means of which about 22 million tons of chlorine per year are produced, has a great relevance.

A diaphragm electrolytic cell is generally composed of four main parts, as known to the experts in the art: a copper anodic base, lined with a protective titanium sheet, an anodic package, consisting in a multiplicity of anodes disposed in parallel rows and secured to said base, a carbon steel cathodic body, comprising a plurality of cathodes upon which a porous diaphragm is deposited, secured to a current distributor and disposed in parallel rows so that they can be intercalated to the above anodes according to a so-called "finger-type" geometry, and a cover, usually of chlorine-resistant plastic material provided with the nozzles for feeding the brine and discharging the product chlorine.

In consideration of the high number of installed cells (about 25000 world-wide), of the high amount of energy involved in their operation (about 60 millions of MWh/year) and of the continuous increase in the cost of electricity, the cell diaphragm technology has been, in the course of the years, remarkably improved. Among the many technological innovations which offered the major contributions for decreasing the energy consumption, the following must be noticed:

- the replacement of the traditional graphite anodes with box-shaped perforated metallic anodes (the so-called "box" type anodes) made of titanium, coated with electrocatalytic material based on noble metals and/or oxides thereof.
- the replacement of fixed sized "box" anodes with the so-called "expandable anodes", as disclosed in U.S. Pat. No. 3,674,676, allowing for the reduction of the interelectrodic gap.
- the suppression of the above interelectrodic gap through the introduction, within the expandable anodes, of means for exerting a pressure between the anodes and the diaphragm, as disclosed in U.S. Pat. No. 5,534,122
- the evolution of the expandable anode through the introduction of the double expander, as disclosed in U.S. Pat. No. 5,993,620, whereto a lower ohmic drop is associated.

It may be observed that the cited innovations are all directed to improve the performances in terms of energetic consumption, by means of either an increase of the electrocatalytic activity, or an optimisation of the electrode structure, or again through the reduction of the interpolar gap and the increase in the mass transfer (lower bubble effect and higher electrolyte circulation) obtained through small modifications which do not imply a substantial redesign of the cell structure and thus of easy implementation and reduced costs.

Other solutions proposed in the past provide a modification of the cell, and in particular of the cathodic package, directed to increase the electrodic surface thereby decreasing the current density at a given applied total current, and as a consequence the cell voltage and the overall energetic consumption.

A further issue of present great relevance is given by the need of increasing the electric load and thus the production; such need is often in contradiction with the lack of a suitable area allowing the installation of additional electrolytic cells. In the co-pending unpublished International Application PCT/EP 02/10848, a solution allowing the increase of the cell active surface with the same projected area is disclosed, by means of the construction of a cell made of a plurality of vertically overlaid modules provided with the conventional interdigitated anodes. This solution is in itself promising, although entailing quite substantial investment costs.

It is an object of the present invention to provide a new diaphragm electrolytic cell overcoming the drawbacks of the prior art.

In particular, it is an object of the present invention to provide a diaphragm electrolytic cell comprising a multiplicity of overlaid modules of anodes and cathodes, the anodes of at least part of the modules allowing for a substantial reduction of the construction cost.

SUMMARY OF THE INVENTION

The invention consists of a diaphragm electrolytic cell made of a lower module and of an upper module or a multiplicity of upper modules vertically overlaid thereto, wherein at least the upper modules are provided with generally U-shaped anodes, comprising two vertical major surfaces fixed to a horizontal current collector, housing the corresponding cathodes within.

The two vertical major surfaces of the anodes may be part of a single folded surface; they are preferably foraminous, to allow the circulation of the electrolyte, and are preferably provided with an electrocatalytic coating for chlorine evolution.

In order to facilitate the understanding of the invention, reference will be made to the attached figures, which are not to be intended as limiting the invention itself, whose domain is solely limited by the appended claims.

DETAILED DESCRIPTION OF THE DRAWINGS

Figure 1:
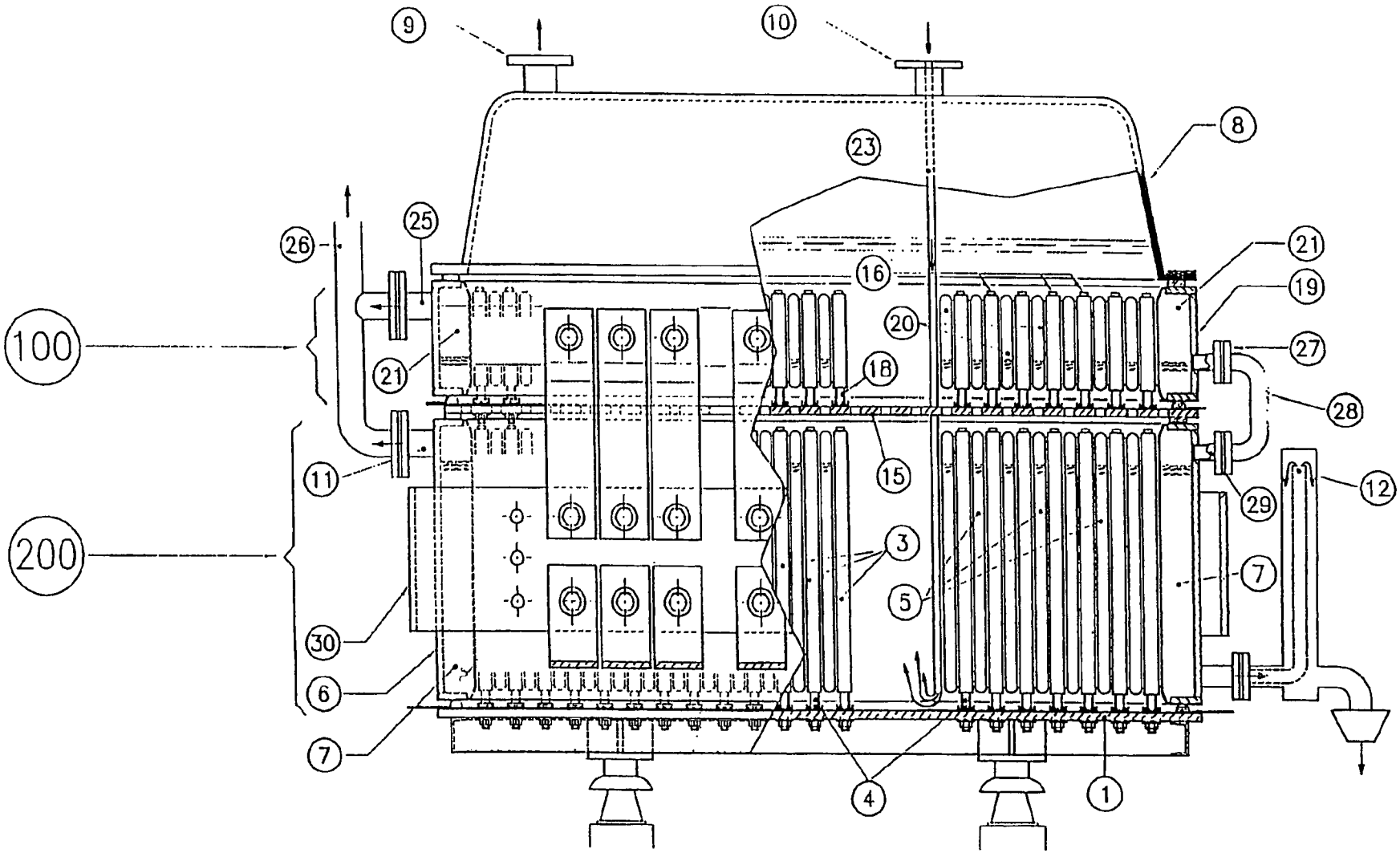
FIG. 1 shows a side view of a diaphragm electrolytic cell of the prior art.

FIG. 1 shows a diaphragm electrolytic cell of the prior art, according to the teaching of the co-pending non published International Application PCT/EP 02/10848. The illustrated cell consists of two vertically overlaid modules, an upper module (100) and a lower module (200), according to the most common embodiment; it is intended that the upper module (100) may be replaced by a plurality of vertically stacked upper modules, as disclosed in the cited co-pending application. The lower module (200) comprises a copper anode base (1), lined with a titanium protective sheet (not evidenced) whereto a plurality of anodes (3) is secured in parallel rows, by means of current collecting stems (4) intercalated to the cathodes (5). The surface of the anodes is preferably made of a grid of perforated sheet or rhomboidal-shaped expanded sheet coated with an electrocatalytic material. The cathodic package consists of a box (6) with open top and bottom, known as cathodic body, with a current distributor (30), provided with a plurality of cathodes (5) fixed inside, secured in correspondence of the external surface thereof. The cathodes (5), known as fingers, are shaped as tubular boxes with a flat elongated cross-section and are arranged in parallel rows intercalated to the rows of anodes (3); the two ends of the cathodes (5) are connected with a manifold (7) running along the four sides of the box (6). The cathode is made for example of an iron perforated sheet or mesh, with the diaphragm deposited on the external surface thereto, facing the anode. The diaphragm has the purpose of separating the anodic compartment from the cathodic one avoiding the mixing of the two gases and of the solutions; originally it was made of polymer modified asbestos, but the technological evolution has led to the adoption of composite asbestos-free diaphragms. The diaphragm may also consist of an ion-exchange membrane or other semipermeable material. The upper module (100) also comprises anodic and cathodic packages, substantially with the same construction materials as in the lower module (200) but in most of the cases of lower height. The upper anodic package is comprised of a frame (15), acting as the upper anodic base and ensuring for the mechanical support and the current distribution for the relevant anodes (16). The frame (15) is made of a titanium sheet provided with holes or slots, suitably dimensioned for putting the two anodic compartments in direct fluid communication. The anodes (16) of the upper module are vertically fixed to the frame, in transversal rows, generally with the same pitch as in the lower module. The anodes (16) of the upper module, fixed to the frame (15) by means of dowel screws (18), often have a lower height. The upper cathodic body is made of a box (19), having the same design and construction materials as that of the lower module and a height depending on that of the upper anodic package; the upper cathodic body is welded along the internal walls of the box (19) to a plurality of cathodes (20) arranged in parallel rows. Each finger, shaped as an elongated tubular box, is in communication with a manifold (21) positioned along the sides of the box (19). The main features of the cathodes and diaphragms of the upper module are equivalent to those of the lower module. The frame (15) and the anode base (1) are reciprocally connected by means of external conductors (not shown in the figure); the box (6) and the box (19) are also connected in a similar way. The cell cover (8), which is made a of plastic chlorine-resistant material, is provided with a chlorine gas outlet (9) and a brine inlet (10). The cell is connected to a direct current supply by means of bus bars. As known to the experts in the art, the cell operates as follows: the feed brine enters the cell through the inlet nozzle (10) placed on the cell cover and is distributed through pipe (23) to the base (1) of the lower anodic compartment, subsequently rising to the top surface thereof and overflowing through the slots of the frame (15) into the anodic space of the box (19). The chlorine disengaged in the lower anodic compartment follows the same path and leaves through the outlet nozzle (9) on the cover (8). The chloride-depleted electrolyte, driven by the pressure corresponding to the hydraulic head between the anolyte and catholyte, permeates through the diaphragm entering the upper (20) and lower (5) cathodic fingers. Hydrogen leaves the upper (21) and lower (7) cathodic compartments respectively through nozzles (25) and (11), connected in parallel to the hydrogen manifold (26). The alkali produced in the upper cathodic compartment (21) leaves through nozzle (27), and enters the lower cathodic chamber (7) through pipe (28) and nozzle (29), where it is mixed with the alkali produced therein, then leaving the cell through the hydraulic head (12). The level of the cathodic liquor is normally adjusted so that a sufficient gas chamber is always maintained in the lower cathodic compartment (7); consequently, the upper compartment (21) works exclusively as a gas chamber and electrolysis takes place only by direct contact between the solution percolating onto the diaphragm and the cathode. To establish such condition in a reliable fashion, the pipe (28) must obviously have a sufficient large diameter in order to remain substantially full of hydrogen, so that the two cathodic compartments (7) and (21) are subjected to an identical pressure.

Figure 2:
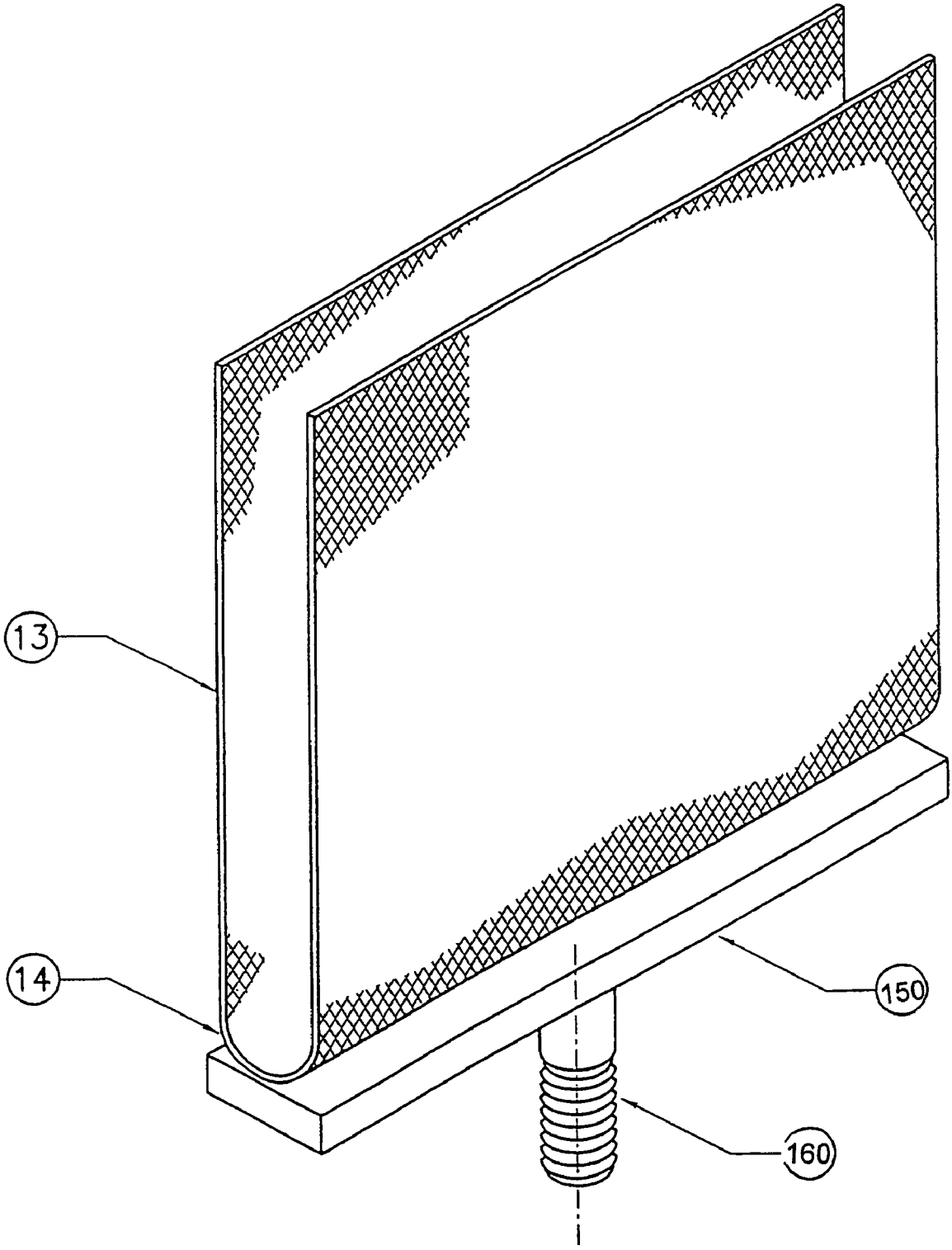
FIG. 2 shows an anode of the cell of the invention according to a first preferred embodiment.

FIG. 2 shows a particular embodiment of the anode of the invention, which is conceived in a completely different manner with respect to the prior art anodes, with or without expander. As it can beobserved, the anode structure is given by an electrodic surface (13), folded and open on one side to allow the insertion of a cathode, preferably consisting of a foraminous sheet or a mesh or, as an alternative, of a juxtaposition of foraminous elements such as sheets or meshes. The anode has a single curvature (14), his profile thereby assuming a U-shaped geometry; other kinds of curvature are however possible without departing from the scope of the invention. At the base of the anode, in correspondence of the curvature (14), a current collector (150) provided with a preferably threaded stem (160) is welded or otherwise secured. The current collector (150) is horizontal instead of vertical as it would be the case of the prior art, as this allows the internal volume of the anode to be hollow and completely available for the insertion of the corresponding cathode. In principle, both the anodes of the upper module (100) and of the lower module (200) could be realized according to the embodiment of FIG. 2. However, the cell construction illustrated in FIG. 1 derives, in most of the case, from a retrofitting of an older diaphragm cell wherein the upper module is overlaid to the lower one in a second time, as disclosed in the co-pending International Application PCT/EP 02/10848. The anodes of the lower module (200) have therefore, in most of the cases, a geometry according to the prior art. Also when a complete replacement of the electrodes of the lower module is carried out, the advantage of employing the anode of FIG. 2 is partially counteracted by the fact that the anodes (3) of the lower module (200) are usually quite high (for instance 800 mm); the lack of an internal current collector way entail, in this case, substantial ohmic penalties thus lowering the faradaic yield. The anodes (16) of the upper module (100) have conversely a much reduced typical height (for instance 160 mm, as specified in the cited International Application PCT/EP 02/10848), and conducting The electric current along their whole height without resorting to internal current collectors is therefore a negligible issue. For this reason, in a preferred embodiment, the cell of the invention makes use of the anodes of FIG. 2 only for the upper module (100).

In another embodiment, the cell of the invention makes use of such anodes also for the lower module (100), counteracting the increase in the ohmic drop along the electrode height with additional vertical current collectors (not shown), secured to the external surfaces of the anodes. The optional additional titanium-lined copper current collectors, secured externally and not internally, are much easier to remove and restore, contributing in a sensible manner to reduce the costs of reactivation.

Fixing the current collectors to the anodes externally instead of internally also offers an additional benefit: when the catalytic coating is periodically deactivated, the anode must be in fact subjected to a reactivation, preceded by an etching treatment in hot concentrated hydrochloric or sulphuric acid. After applying the catalytic ink, the anode must be treated in oven at about 500° C. During these treatments, the bimetallic contact between the copper core of the state-ofthe-art current collector and the relevant titanium lining would be seriously damaged by distortion phenomena, the previous detachment of the current collector and his subsequent restoring after the treatment being therefore required. With the illustrated anode however, the horizontal current collector can be entirely made of titanium, with little prejudice in terms of ohmic drops, therefore no problems arise during the heat treatment of reactivation.

Figure 3:
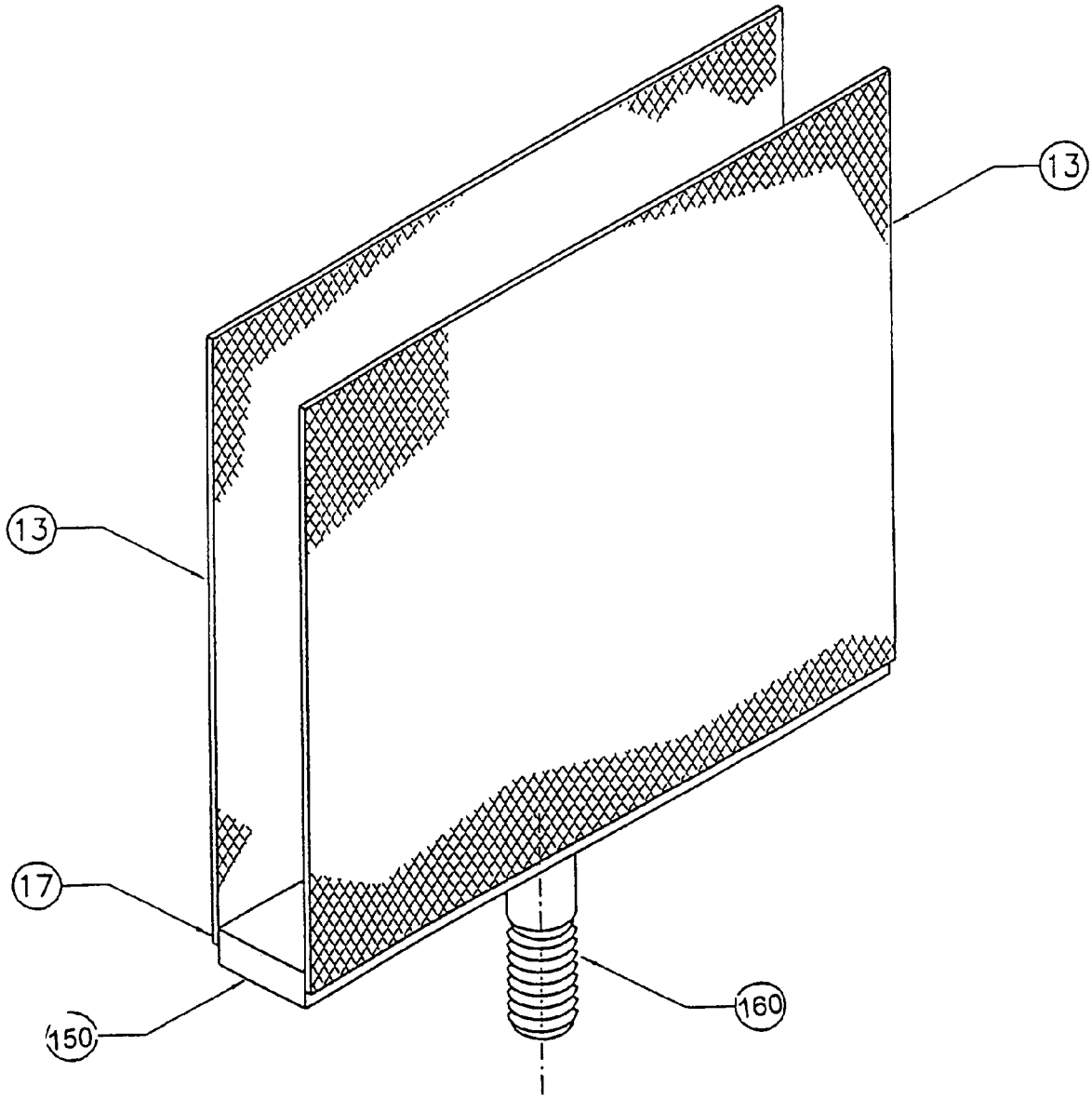
FIG. 3 shows an anode of the cell of the invention according to a second preferred embodiment.

FIG. 3 shows a second particular embodiment of the anode of the invention, whose conception is not too far from the anode of FIG. 2. Once more, its structure is open allowing the cathode to be housed within; in this case, however, the electrodic surface (13) is formed by two distinct elements, disposed in the vertical position and secured to the current collector (150) in correspondence of one edge (17). The nature of the electrodic surface (13) is fundamentally equivalent to the one described for the previous embodiment; the use of foraminous elements such as sheets or meshes, or juxtapositions thereof, is preferred.

Figure 4A:
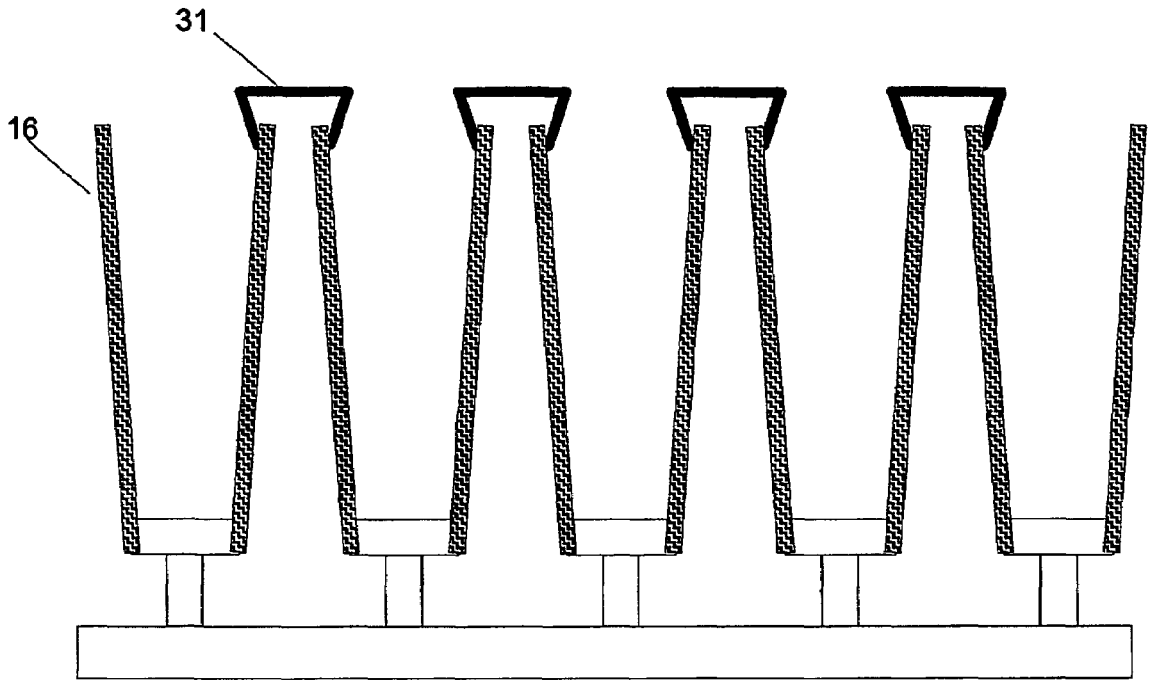
FIGS. 4A and 4B show an arrangement of anodes and cathodes in a module of the diaphragm electrolytic cell of the invention.
Figure 4B:
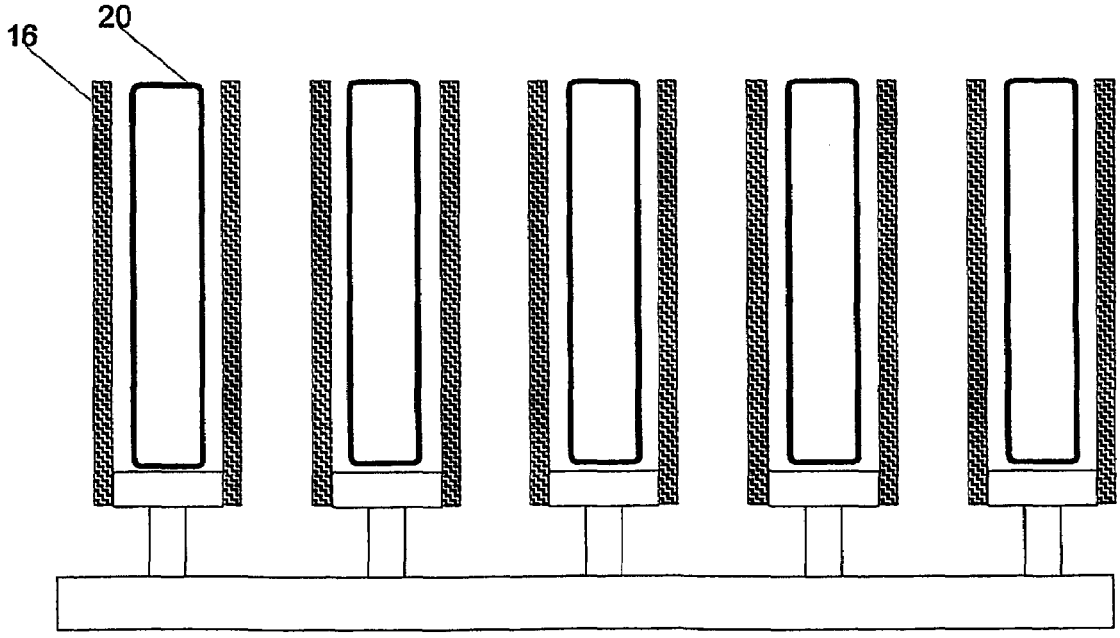

FIG. 4 is a sketch of a side view of a possible configuration of an upper module (100), according tote best mode of carrying out the invention; the same configuration could be used for the lower module (200), without departing from the scope of the invention. The particular shape of the anode (16), with an open upper part and the interior free of obstacles, maybe exploited for housing the cathode (20) within, so that the reduction of the electrode pitch is virtually limited by the sole thickness of the cathode (20). The adjacent anodes, m fact, can be very close to each other as even in mutual contact, as they are maintained at the same electric potential. The figure shows also constraint elements (31), applied to adjacent pairs of anodes, that are used to open wide the latter under elastic regime so as to facilitate the insertion of the cathodes during the assembly (FIG. 4A); FIG. 4B shows how, upon completing the assembly and removing the constraint elements, the anodic surface moves back to the natural position, with the two vertical sides facing the diaphragm-coated major surfaces of the corresponding cathode (20). In FIG. 4, the anode (16) has an open upper part, but it is clearly possible to assemble the anodes upside down, with an open lower part. It is also possible to provide an assembly procedure that doesn't make use of constraint elements, or that utilises the same in a different fashion, without departing from the scope of the invention. The constructive solution illustrated in FIG. 4 easily allows an increase of active surface of 30-50% for the relevant module and for a given projected surface.

In the description and claims of the present application, the word "comprise" and its variation such as "comprising" and "comprises" are not intended to exclude the presence of other elements or additional components.

The invention claimed is:

1. A diaphragm electrolytic cell for the electrolytic production of chlorine and alkali comprising a lower module equipped with a lower anodic package and a lower cathodic package and at least one upper module overlaid thereon equipped with an upper anodic package and an upper cathodic package, said modules being hydraulically connected in series, said hydraulic connection in series comprising an external manifold for the product alkali and a direct fluid communication between said upper anodic package and said lower anodic package by means of holes or slots provided in a conductive frame acting as a base for said upper anodic package, wherein at least one of said modules is equipped with U-shaped anodes comprising two vertical major surfaces fixed to a first horizontal current collector, additional titanium-lined copper current collectors being externally secured to at least one of said vertical major surfaces, diaphragm-coated cathodes being housed in the hollow space inside said vertical major surfaces.

2. The cell of claim 1 wherein said vertical major surfaces of said anodes are parts of a single folded surface delimited by a curvature, said horizontal current collector being fixed to said vertical major surfaces in correspondence of said curvature.

3. The cell of claim 1 wherein at least one of said vertical major surfaces of said anodes is foraminous.

4. The cell of claim 3 wherein said at least one foraminous vertical major surface of said anodes consists of a foraminous sheet or of a mesh or of a juxtaposition of foraminous sheets or meshes.

5. The cell of claim 1 wherein said U-shaped anodes are entirely made of titanium or titanium alloys.

6. The cell of claim 1 wherein said at least one upper module is equipped with U-shaped anodes.

7. The cell of claim 4 wherein said U-shaped anodes are entirely made of titanium or titanium alloys.

8. The cell of claim 1 wherein said at least one upper module is equipped with U-shaped anodes.

9. The cell of claim 3 wherein said at least one upper module is equipped with U-shaped anodes.

10. The cell of claim 5 wherein said at least one upper module is equipped with U-shaped anodes.

11. The cell of claim 1 wherein said horizontal current collector is made of titanium.

12. The cell of claim 3 wherein said horizontal current collector is made of titanium.

13. The cell of claim 4 wherein said horizontal current collector is made of titanium.

14. The cell of claim 11 wherein all of said lower and upper modules are provided with said U-shaped anodes.

15. The cell of claim 12 wherein all of said lower and upper modules are provided with said U-shaped anodes.

16. The cell of claim 13 wherein all of said lower and upper modules are provided with said U-shaped anodes.

17. The cell of claim 1 wherein at least said vertical major surfaces are provided with a catalytic coating for chlorine evolution.

18. The cell of claim 3 wherein at least vertical major surfaces are provided with a catalytic coating for chlorine evolution.

19. The cell of claim 4 wherein at least said vertical major surfaces are provided with a catalytic coating for chlorine evolution.

20. The cell of claim 5 wherein at least said vertical major surfaces are provided with a catalytic coating for chlorine evolution.

21. A method for the assembly of the cell of claim 1, comprising fixing said U-shaped anodes to the corresponding anodic base, maintaining said anodes open wide under an elastic regimen by means of constraint elements, housing said diaphragm-coated cathodes within said hollow space inside said vertical major surfaces of said anodes and removing said constraint elements.

22. A process for the production of chlorine and caustics comprising applying a direct electric current to a cell of claim 1 fed with an alkali chloride solution.

23. The process of claim 22 wherein said caustics comprise sodium hydroxide and said alkali chloride solution comprises sodium chloride brine.

* * * * *